US006013974A

United States Patent [19]

Haven et al.

[11] Patent Number: 6,013,974

[45] Date of Patent: Jan. 11, 2000

[54] ELECTRON-EMITTING DEVICE HAVING FOCUS COATING THAT EXTENDS PARTWAY INTO FOCUS OPENINGS

[75] Inventors: Duane A. Haven, Umpqua, Oreg.; Christopher J. Spindt, Menlo Park; N. Johan Knall, Sunnyvale, both of Calif.

[73] Assignee: Candescent Technologies Corporation, San Jose, Calif.

[21] Appl. No.: 08/866,554

[22] Filed: May 30, 1997

[51] Int. Cl.[7] ..... H01J 1/30; H01J 19/24

[52] U.S. Cl. ..... 313/309; 313/336; 313/496

[58] Field of Search ..... 313/309, 310, 313/336, 351, 422, 495, 496, 497, 452; 345/74, 75; 445/24, 50

[56] References Cited

U.S. PATENT DOCUMENTS

| | | | |
|---|---|---|---|
| 4,178,531 | 12/1979 | Alig | 313/409 |
| 4,874,981 | 10/1989 | Spindt | 313/309 |
| 5,070,282 | 12/1991 | Epsztein | 315/383 |
| 5,191,217 | 3/1993 | Kane et al. | 250/423 |
| 5,235,244 | 8/1993 | Spindt | 313/495 |
| 5,315,207 | 5/1994 | Hoeberechts et al. | 313/444 |
| 5,347,292 | 9/1994 | Ge et al. | 313/309 |
| 5,514,847 | 5/1996 | Makishima et al. | 313/309 |
| 5,528,103 | 6/1996 | Spindt et al. | 313/497 |
| 5,543,683 | 8/1996 | Haven et al. | 313/461 |
| 5,559,389 | 9/1996 | Spindt et al. | 313/310 |
| 5,564,959 | 10/1996 | Spindt et al. | 445/24 |
| 5,578,899 | 11/1996 | Haven et al. | 313/495 |
| 5,649,847 | 7/1997 | Haven | 445/24 |
| 5,650,690 | 7/1997 | Haven | 313/422 |
| 5,763,987 | 6/1998 | Morikawa et al. | 313/309 |
| 5,786,656 | 7/1998 | Hasegawa et al. | 313/309 |
| 5,801,485 | 9/1998 | Van Veen et al. | 313/495 |

FOREIGN PATENT DOCUMENTS

| | | | |
|---|---|---|---|
| W/O 92/09095 | 5/1992 | WIPO | H01J 3/02 |
| W/O 96/16429 | 5/1996 | WIPO | H01J 31/12 |

*Primary Examiner*—Sandra O'Shea
*Assistant Examiner*—Michael Day
*Attorney, Agent, or Firm*—Skjerven, Morroll, Macpherson, Franklin & Friel LLP; Ronald J. Meetin

[57] ABSTRACT

An electron-emitting device contains an electron focusing system (37 or 37A) formed with a base focusing structure (38 or 38A) and a focus coating (39 or 39A) that penetrates partway into a focus opening (40) extending through the base focusing structure above an electron-emissive element (24). The focus coating is normally of lower resistivity than the base focusing structure and thereby provides most of the focus control over electrons emitted by the electron-emissive element. The focus coating is typically formed by an angled deposition technique.

56 Claims, 8 Drawing Sheets

ELECTRON-EMITTING DEVICE HAVING FOCUS COATING THAT EXTENDS PARTWAY INTO FOCUS OPENINGS

CROSS REFERENCE TO RELATED APPLICATION

This is related to Barton et al, co-filed U.S. patent application Ser. No. 08/866,151, the contents of which are incorporated by reference to the extent not repeated herein.

FIELD OF USE

This invention relates to electron-emitting devices. More particularly, this invention relates to the structure and fabrication of an electron-emitting device suitable for use in a flat-panel display of the cathode-ray tube ("CRT") type.

BACKGROUND

FIG. 1 illustrates the basic features in the active area of a conventional color flat-panel CRT display that operates according to field-emission principles. The field-emission display ("FED") in FIG. 1 consists of an electron-emitting device and a light-emitting device. The electron-emitting device, commonly referred to as a cathode, contains electron-emissive elements 1 that emit electrons over a wide area. The emitted electrons are directed towards light-emissive elements 2 distributed over a corresponding area in the light-emitting device. Upon being struck by the electrons, light-emissive elements 2 emit light that produces an image on the viewing surface of the FED.

Specifically, electron-emissive elements 1 are situated over emitter electrodes 3, one of which is shown in FIG. 1. Control electrodes 4 cross over, and are electrically insulated from, emitter electrodes 3. A set of electron-emissive elements 1 are electrically coupled to each emitter electrode 3 where it is crossed by a control electrode 4. For simplicity, FIG. 1 depicts only one electron-emissive element 1 at each electrode crossing location. When a suitable voltage is applied between a control electrode 4 and an emitter electrode 3, that control electrode 4 extracts electrons from associated electron-emissive element 1. An anode (not shown) in the light-emitting device attracts the electrons to light-emissive elements 2 laterally separated by black matrix 5 over transparent faceplate 6.

Electron emission from a single electron-emissive element 1 under the control of associated control electrode 4 is generally distributed throughout a solid cone with a maximum half angle greater than 45° relative to the vertical in FIG. 1. For reference purposes, FIG. 1 illustrates a 45°-half angle cone at the tip of one electron-emissive element 1. At the light-emitting device, undeflected electrons are distributed over an area generally represented by item 7 in FIG. 1. Area 7 increases as the distance between the cathode and anode structures increases. As FIG. 1 illustrates, undeflected electrons emitted by one electron-emissive element 1 can strike area outside intended light-emissive element 2.

FEDs that operate at high anode voltages for improved brightness and lifetime require comparatively large cathode-to-anode spacings in order to avoid electrical arcing between components of the anode and cathode structures. The potentialities of having electrons strike undesired places, e.g., light-emissive elements 2 adjacent to intended light-emissive element 2, are therefore of special concern for FEDs operating with high anode voltages.

The electron-emitting device in an FED commonly contains a focusing system that helps control the trajectories of the electrons so that they largely only strike the intended light-emissive elements. The focusing system normally extends above the control electrodes. The lateral relationship of the focusing system to the sets of electron-emissive elements is critical to achieving high display performance.

FIGS. 2*a*–2*c* illustrate a conventional variation of the FED of FIG. 1 to which a focusing system 8 has been added. Focusing system 8 locally deforms the electric field existing between the anode and cathode structures to form an electron lens that alters the electron trajectories. The amount of change in the electron trajectories depends on factors such as the initial trajectories, the strength of the electron lens, and the times of flight within the lens. Ideally, the characteristics of focusing system 8 are chosen in such a way that substantially all impinging electrons strike intended electron-emissive element 2 as indicated in FIG. 2*a*. However, the electrons often strike undesired areas when the electron lens is underfocused as shown in FIG. 2*b* or overfocused as shown in FIG. 2*c*.

The ability of the electron lens to properly focus the emitted electrons depends on the physical characteristics of the focusing system. Generally, the focusing system needs to be capable of maintaining a desired potential. U.S. Pat. No. 5,528,103 illustrates various configurations for an electron focusing system that can maintain a potential in an FED. Unfortunately, all of the focusing systems in U.S. Pat. No. 5,528,103 either provide insufficient focusing capability or raise concerns with respect to electrical short circuiting to the control electrodes.

It is desirable to have a focusing system that provides a suitable amount of electron focusing for an electron-emitting device without running any significant risk that electrically conductive material in the focusing system will be electrically shorted to other components such as control electrodes. It is also desirable to have a technique for readily fabricating such a focusing system.

GENERAL DISCLOSURE OF THE INVENTION

The present invention furnishes an electron focusing system for an electron-emitting device suitable for use in a flat-panel CRT display, especially an FED. In a fundamental form of an electron-emitting device that employs the present electron focusing system, electrons are emitted by an electron-emissive element situated in an opening in a dielectric layer. The electron-emissive element is exposed through a control opening in a control electrode that overlies the dielectric layer.

The electron focusing system of the invention is formed with a base focusing structure and a focus coating. The base focusing structure overlies the dielectric layer and has a focus opening that largely overlies the electron-emissive element. Electrons emitted by the electron-emissive element travel through the focus opening.

The focus coating overlies the base focusing structure within the focus opening. Importantly, the focus coating extends only partway down into the focus opening—i.e., the focus coating stops short of the bottom of the focus opening. The focus coating is normally of lower resistivity than the base focusing structure. Consequently, the focus coating normally provides the large majority of the focus control over the emitted electrons.

Configuring the present focusing system so that the focus coating extends only partway into the focus opening provides two benefits. Firstly, the focus coating is normally automatically spaced apart from the control electrode. Short circuiting of the focus coating to the control electrode is avoided. Secondly, a desired degree of focus control is attained in the invention by simply adjusting the amount that the focus coating extends into the focus opening. In short, extension of the focus coating partway into the focus opening readily enables excellent focus control to be achieved while largely avoiding short-circuit problems.

The base focusing structure is typically formed with electrically non-conductive material. As mentioned below, "electrically non-conductive" means electrically insulating or electrically resistive. Subject to the focus coating having lower resistivity than the base focusing structure, the focus coating is typically formed with electrically non-insulating material. As likewise mentioned below, "electrically non-insulating" means electrically conductive or electrically resistive. The focus coating material preferably consists primarily of one or more of aluminum, chromium, nickel, gold, and silver.

The focus coating is typically formed according to an angled deposition technique. That is, the focus coating is deposited over the base focusing structure at an incidence angle less than 90° measured relative to a plane running generally parallel to the dielectric layer. The incidence angle is sufficiently small that the focus coating material accumulates only partway into the focus opening during the angled deposition.

In an electron-emitting device, there is often a characteristic lateral direction in which electron focus control is most critical. For example, consider a situation in which the focus opening is of greater dimension in a first lateral direction than in a second lateral direction perpendicular to the first direction. Assume that focus control is more critical in the second direction than in the first direction.

If the focus coating material were deposited from an angled deposition source that, relative to an electron-emitting device under fabrication, is being simultaneously rotated around the device at a largely constant incidence angle (less than 90°), the greater dimension of the focus opening in the first direction would normally result in unequal accumulation of the focus coating material in the focus opening. Attempting to set the deposition incidence angle at a value that yields optimum (or near optimum) focus control in the second direction—i.e., the direction in which focus control is more critical—could lead to an undesirable result. Specifically, the focus coating material that impinges instantaneously on the focus opening with substantial lateral velocity in the first direction could readily reach the bottom of the focus opening and short circuit the focus coating to the control electrode even though the focus coating material that impinges instantaneously on the focus opening with substantial lateral velocity in the second direction only goes partway into the focus opening.

The foregoing problem is addressed in the invention by performing the angled focus coating deposition from two suitably chosen opposite positions located outside, and on opposite sides of, the focus opening. As used here, a deposition "position" means a location from which material, such as the focus coating material, is directed toward a target, such as the focus opening.

The advantage of the present opposite-position deposition technique can be seen by considering what happens if the focus opening is defined by a pair of opposing first sidewalls that respectively meet a pair of opposing second sidewalls. The angled deposition is then done from opposite positions behind the first sidewalls such that the focus coating material accumulates only partway down the first sidewalls. By arranging for the two oppositely located deposition positions to be adequately far away from the focus opening and/or by suitably restricting the half angle through which the focus coating material is directed from each of the positions toward the focus opening, the focus coating material usually accumulates nowhere deeper down the second sidewalls than down the first sidewalls. This is true regardless of whether the first sidewalls are laterally longer, or shorter, than the second sidewalls.

Next, let the first sidewalls extend in the first direction mentioned above, while the second sidewalls extend in the second direction. Assume, as in the above-mentioned problem, that focus control is more critical in the second direction than the first, but that the focus opening is of greater dimension in the first direction than the second. The first sidewalls are therefore longer than the second sidewalls.

By depositing the focus coating material according to the opposite-position technique of the invention, the distance to which the focus coating material accumulates down the second sidewalls is normally nowhere greater than the distance to which the focus coating material accumulates down the first sidewalls even though they are the longer sidewalls. This is precisely what is needed when, as here, focus control is more critical in the second direction. The present deposition technique thereby yields desired focus control while avoiding short circuiting of the focus coating to the control electrode.

Both deposition positions can be translated in a given direction—e.g., in the first direction—during the deposition from each position. Translating the deposition positions in this manner helps improve the thickness uniformity of the focus coating and, when there are multiple focus openings extending in the given direction, the uniformity from opening to opening of the depth to which the focus coating extends into the focus openings. Also, translation of the deposition positions in a given direction facilitates depositing the focus coating over a large area, thereby alleviating the need for an extremely large deposition system.

The present deposition technique is highly flexible. The deposition parameters can be adjusted to accommodate various device sizes and resolutions. In short, the invention provides a significant advance.

BRIEF DESCRIPTION OF THE DRAWINGS

FIGS. 2*a*–2*c* respectively illustrate conditions of acceptable focusing, underfocusing, and overfocusing.

Like reference symbols are employed in the drawings and in the description of the preferred embodiments to represent the same, or very similar, item or items.

DESCRIPTION OF THE PREFERRED EMBODIMENTS

The present invention furnishes a matrix-addressed electron-emitting device in which electron focusing is achieved with a focus coating that extends partway into focus openings so as to alleviate short circuiting concerns. The electron emitter of the invention typically operates according to field-emission principles in producing electrons that cause visible light to be emitted from corresponding light-emissive phosphor elements of a light-emitting device. The combination of the electron-emitting and light-emitting devices forms a cathode-ray tube of a flat-panel display such as a flat-panel television or a flat-panel video monitor for a personal computer, a lap-top computer, or a workstation.

In the following description, the term "electrically insulating" (or "dielectric") generally applies to materials having a resistivity greater than $10^{10}$ ohm-cm. The term "electrically non-insulating" thus refers to materials having a resistivity below $10^{10}$ ohm-cm. Electrically non-insulating materials are divided into (a) electrically conductive materials for which the resistivity is less than 1 ohm-cm and (b) electrically resistive materials for which the resistivity is in the range of 1 ohm-cm to $10^{10}$ ohm-cm. These categories are determined at an electric field of no more than 1 volt/$\mu$m. Similarly, the term "electrically non-conductive" refers to materials having a resistivity of at least 1 ohm-cm, and includes electrically resistive and electrically insulating materials.

Examples of electrically conductive materials (or electrical conductors) are metals, metal-semiconductor compounds (such as metal silicides), and metal-semiconductor eutectics. Electrically conductive materials also include semiconductors doped (n-type or p-type) to a moderate or high level. Electrically resistive materials include intrinsic and lightly doped (n-type or p-type) semiconductors. Further examples of electrically resistive materials are (a) metal-insulator composites, such as cermet (ceramic with embedded metal particles), (b) forms of carbon such as graphite, amorphous carbon, and modified (e.g., doped or laser-modified) diamond, (c) and certain silicon-carbon compounds such as silicon-carbon nitrogen.

Figure 1:
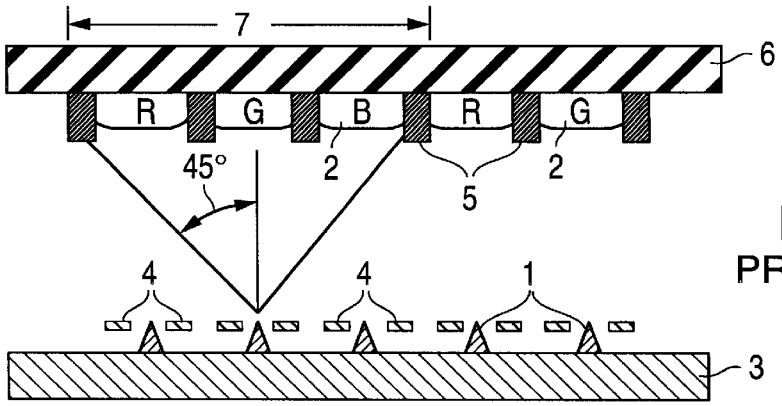
Fig. 1 PRIOR ART
FIG. 1 is a simplified cross-sectional schematic side view of a portion of a conventional electron-emitting device.
Figure 2A:
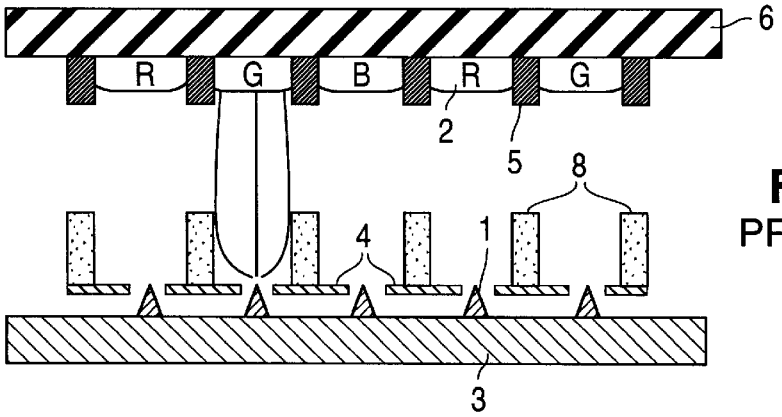
Fig. 2a PRIOR ART
FIGS. 2*a*, 2*b* and 2*c* are simplified cross-sectional schematic side views of a portion of a conventional electron-emitting device having a focusing system.
Figure 2B:
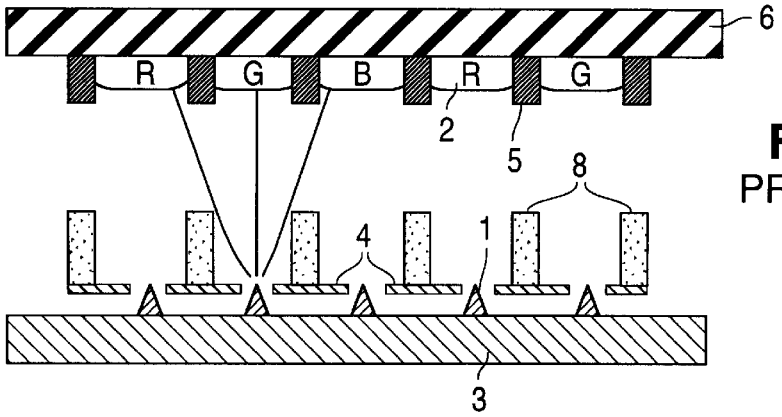
Fig. 2b PRIOR ART
Figure 2C:
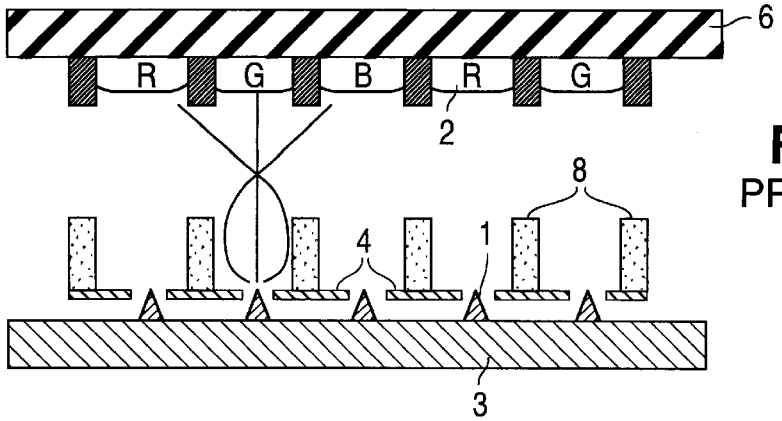
Fig. 2c PRIOR ART
Figure 3:
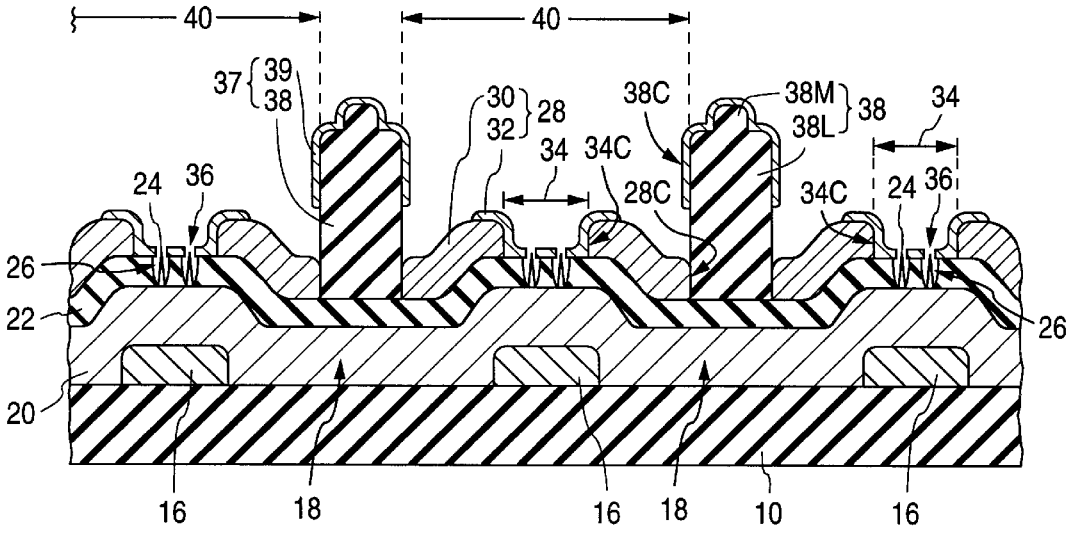
FIG. 3 is a cross-sectional side view of a portion of a electron-emitting device having a focusing system configured according to the invention. The cross section of FIG. 3 is taken through plane 3—3 in each of FIGS. 4 and 5.
Figure 4:
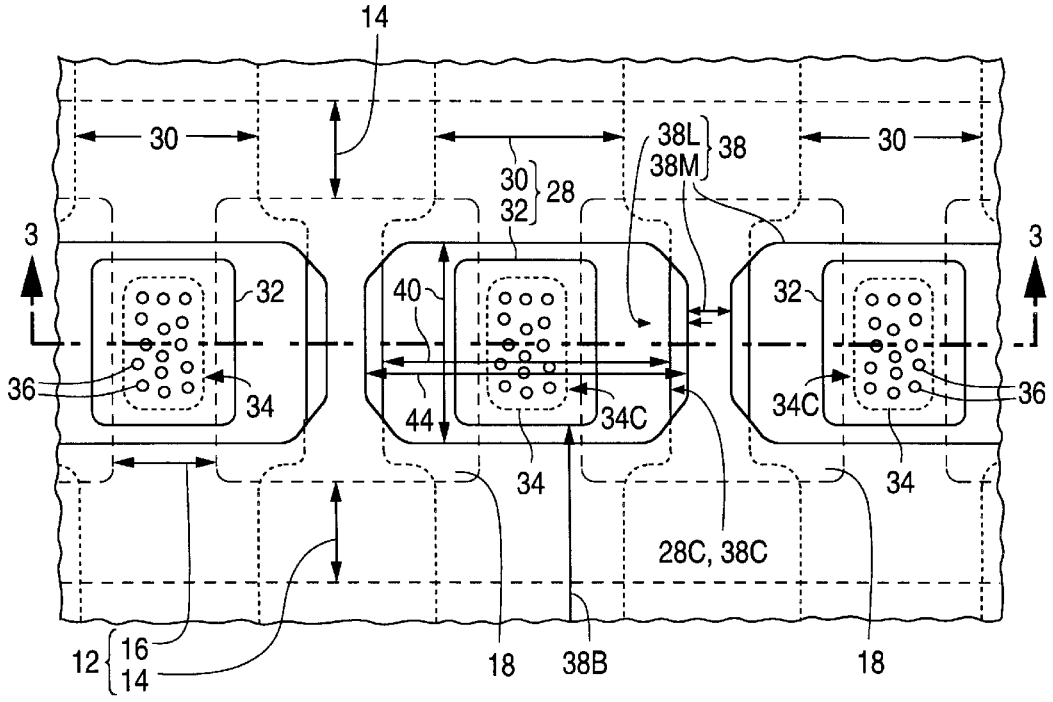
FIG. 4 is a plan view of the portion of the electron-emitting device in FIG. 1.

Referring to the drawings, FIG. 3 illustrates a side cross section of part of a matrix-addressed electron-emitting device that contains a focusing system configured according to the invention. The device in FIG. 3 operates in field-emission mode and is often referred to here as a field emitter. FIG. 4 depicts a plan view of the part of the field emitter shown in FIG. 3. To simplify pictorial illustration, dimensions in the vertical direction in FIG. 4 are illustrated at a compressed scale compared to dimensions in the horizontal direction.

The field emitter of FIGS. 3 and 4 is employed in a color FED divided into rows and columns of color picture elements ("pixels"). The row direction—i.e., the direction along the rows of pixels—is the horizontal direction in FIGS. 3 and 4. The column direction, which extends perpendicular to the row direction and thus along the columns of pixels, extends perpendicular to the plane of FIG. 3. The column direction extends vertically in FIG. 4. Each color pixel contains three sub-pixels, one for red, another for green, and the third for blue.

The field emitter of FIGS. 3 and 4 is created from a thin transparent flat baseplate 10 typically consisting of glass such as Schott D263 glass having a thickness of approximately 1 mm. A group of opaque parallel emitter electrodes 12 are situated on baseplate 10 and extend in the row direction to form row electrodes. Each emitter electrode 12 is, in plan view, generally shaped like a ladder consisting of a pair of rails 14 and a group of crosspieces 16 separated by emitter openings 18. Electrodes 12 are typically formed with an alloy of nickel or aluminum to a thickness of 200 nm.

An electrically resistive layer 20 is situated on emitter electrodes 12. Resistive layer 20 provides a resistance of at least $10^6$ ohms, typically $10^{10}$ ohms, between each emitter electrode 12 and, as described below, each overlying electron-emissive element. Layer 20 typically consists of cermet having a thickness of 0.3–0.4 $\mu$m. A transparent dielectric layer 22 overlies resistive layer 20. Dielectric layer 22 typically consists of silicon oxide having a thickness of 0.1–0.2 $\mu$m.

A group of laterally separated sets of electron-emissive elements 24 are situated in openings 26 extending through dielectric layer 22. Each set of electron-emissive elements 24 occupies an emission region that overlies one crosspiece 16 in each emitter electrode 12. The particular elements 24 overlying each emitter electrode 12 are electrically coupled to that electrode 12 through resistive layer 22. Elements 24 can be shaped in various ways. In the example of FIG. 3, elements 24 are generally conical in shape and typically consist of molybdenum.

A group of composite generally parallel opaque control electrodes 28 are situated on dielectric layer 22 and extend in the column direction to form column electrodes. Each control electrode 28 controls one column of sub-pixels. Three consecutive electrodes 28 thus control one column of pixels.

Each control electrode 28 consists of a main control portion 30 and a group of adjoining gate portions 32 equal in number to the number of emitter electrodes 12. Main control portions 30 extend fully across the field emitter in the column direction. Gate portions 32 are partially situated in large control openings 34 extending through main portions 30. Electron-emissive elements 24 are exposed through gate openings 36 in the segments of gate portions 32 situated in large control openings 34. Inasmuch as control openings 34 laterally bound the emission regions for the sets of electron-emissive elements 24, each control opening 34 is sometimes referred to as a "sweet spot". Main control portions 30 typically consist of chromium having a thickness of 0.2 $\mu$m. Gate portions 32 typically consist of chromium having a thickness of 0.04 $\mu$m.

An electron focusing system 37, generally arranged in a waffle-like pattern as viewed perpendicularly to the upper surface of faceplate 10, is situated on the parts of main control portions 30 and dielectric layer 22 not covered by control electrodes 28. Referring to FIG. 3, focusing system 37 is formed with an electrically non-conductive base focusing structure 38 and a thin electrically non-insulating focus coating 39 situated over part of base focusing structure 38. Inasmuch as focus coating 39 is thin and generally follows the lateral contour of base focusing structure 38, only the plan view of base structure 38 of focusing system 37 is illustrated in FIG. 4.

Non-conductive base focusing structure 38 normally consists of electrically insulating material but can be formed with electrically resistive material of sufficiently high resistivity as to not cause control electrodes 28 to be electrically coupled to one another. Non-insulating focus coating 39 normally consists of electrically conductive material, typically a metal such as aluminum having a thickness of 100 nm. Other candidates for focus coating 39 are chromium, nickel, gold, and silver. The sheet resistance of focus coating 39 is typically 1–10 ohms/sq. In certain applications, coating 39 can be formed with electrically resistive material. In any event, the resistivity of coating 39 is considerably less than that of base structure 38.

Base focusing structure 38 has a group of openings 40, one for each different set of electron-emissive elements 24. In particular, focus openings 40 expose gate portions 32. Focus openings 40 are concentric with, and larger than, large control openings (sweet spots) 34.

In FIG. 4, the greater dimensional compression in the column (vertical) direction than in the row (horizontal) direction causes focus openings 40 to appear longer in the row direction than in the column direction. Actually, the opposite case normally arises. The lateral dimension of openings 40 in the row direction is usually 50–150 $\mu$m, typically 80–90 $\mu$m. The lateral dimension of openings 40 in the column direction is usually 75–300 $\mu$m, typically 120–140 $\mu$m, and thus is normally significantly greater than the lateral dimension of openings 40 in the row direction.

Focus coating 39 lies on the top surface of base focusing structure 38 and extends partway, typically in the vicinity of up to 50–75% of the way, into focus openings 40. Although non-conductive base focusing structure 38 contacts control electrodes 28, non-insulating focus coating 39 is everywhere spaced apart from control electrodes 28. As viewed perpendicularly to the upper surface of baseplate 10, each different set of electron-emissive elements 24 is laterally surrounded by base structure 38 and thus by coating 39.

Focusing system 37, primarily non-insulating focus coating 39, focuses electrons emitted from each set of electron-emissive elements 24 so that the electrons impinge on phosphor material in the corresponding light-emissive element of the light-emitting device situated opposite the electron-emitting device. In other words, focusing system 37 focuses electrons emitted from electron-emissive elements 24 in each sub-pixel so as to strike phosphor material in the same sub-pixel. Efficient performance of the electron focusing function requires that coating 39 extend considerably above elements 24 and that certain lateral distances from each set of elements 24 to certain parts of system 37, specifically certain parts of coating 39, be controlled well.

More particularly, pixels are typically largely square with the three sub-pixels of each pixel being arranged in a line extending in the row direction. Portions of the active pixel area between rows of pixels are typically allocated for receiving edges of spacer walls. As a result, large control openings 34 are typically considerably closer together in the row direction than in the column direction. Better focus control is thus necessary in the row direction than in the column direction. Accordingly, the critical distances that need to be controlled to achieve good electron focusing are the row-direction distances from lateral edges of focusing system 37 to the nearest edges 34C of large control openings 34. Since edges 34C extend in the column direction, they are referred to here as column-direction edges.

The internal pressure in the FED that contains the field emitter of FIGS. 3 and 4 is very low, generally in the vicinity of $10^{-7}$–$10^{-6}$ torr. With baseplate 10 being thin, focusing system 37 also serves as a surface contacted by spacers, typically spacer walls, that enable the FED to resist external forces such as air pressure while maintaining a desired spacing between the electron-emitting and light-emitting parts of the display.

The preceding distance and spacer-contact considerations are addressed by configuring base focusing structure 38 as a tall main base portion 38M and a group of opposing pairs of critically aligned further base portions 38L. The two further base focusing portions 38L in each of the opposing pairs of further base portions 38L are situated on opposite sides of a corresponding one of large control openings 34. In the example of FIG. 3, further base focusing portions 38L are slightly shorter than main base focusing portion 38M. Parts of focus coating 39 extend partway down the sidewalls of shorter focusing portions 38L into focus openings 40.

Each pair of opposing shorter base focusing portions 38L have lateral column-direction edges 38C vertically aligned to portions 28C of the outer lateral edges of the particular control electrode 28 that controls the corresponding set of electron-emissive elements 24. The row-direction distances from each pair of control-electrode edge portions 28C, and therefore from the corresponding pair of focusing-structure column-direction edges 38C, to the column-direction edges 34C of large control opening 34 for the corresponding set of electron-emissive elements 24 are determined by fixed photomask dimensions and are therefore well controlled. Hence, the portions of focus coating 39 overlying each pair of opposing focusing portions 38L are spaced apart from the corresponding set of electron-emissive elements 24 by well-controlled row-direction distances.

Figure 5:
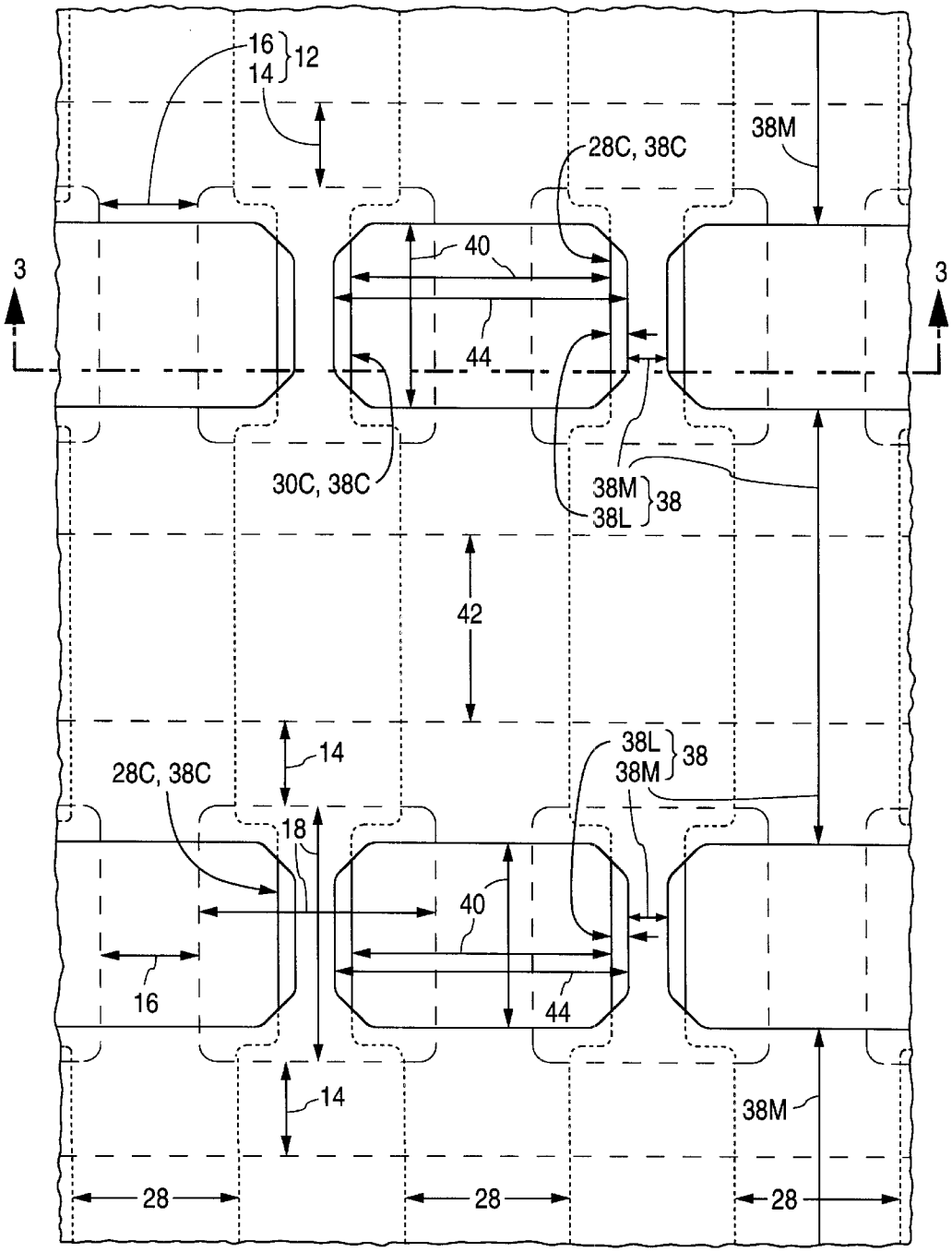
FIG. 5 is a plan view of the base focusing structure, column electrodes, and two emitter electrodes in the electron-emitting device of FIG. 3.

The full plan-view configuration of base focusing structure 38 with respect to electrodes 28 and 12 can be seen in FIG. 5 oriented the same as FIG. 4. FIG. 5 depicts two emitter electrodes 12. Item 42 in FIG. 5 indicates the area between each pair of consecutive electrodes 12. During display assembly, spacer walls are brought into contact with parts of focus coating 39 overlying main focusing portion 38M generally along some or all of areas 42. If desired, strips of main focusing portion 38M above spacer-contact areas 42 can be replaced with focusing material that extends to approximately the same height as shorter focusing portions 38L so as to provide grooves in base focusing portion 38, as covered there with focus coating 39, for receiving edges of the spacer walls.

Base focusing structure 38 is normally created from negative-tone electrically insulating actinic material which is selectively exposed to actinic radiation and developed. The actinic material is preferably photo-polymerizable polyimide, typically Olin OCG7020 polyimide. Main focusing portion 38M typically extends 45–50 $\mu$m above dielectric layer 22. Further focusing portions 38L are normally 10–20% shorter than main portion 38M.

During display operation, a suitable potential is applied to focusing system 37, specifically to focus coating 39, to control the electron focusing. The focus control potential is of such a value, typically 25–50 volts relative to ground, as to cause electrons emitted from each set of electron-emissive elements 24 to be focused on the corresponding (directly opposite) phosphor region in the light-emitting device.

The field emitter of FIGS. 3–5 is typically fabricated in the following manner. A blanket layer of the emitter-electrode material is deposited on baseplate 10 and patterned using a photoresist mask to produce ladder-shaped emitter electrodes 12. Resistive layer 20 is deposited on top of the resultant structure. Dielectric layer 22 is deposited on resistive layer 20.

A blanket layer of the electrically conductive material for main control portions 30 is deposited on layer 22 and patterned using a photoresist mask to form main control portions 30, including control openings 34. The photoresist mask is created from a photomask (reticle) bearing the desired pattern for main control portions 30, including column-direction edges 34C of openings 34.

A blanket layer of the gate material is deposited on top of the structure and patterned using another photoresist mask to form gate portions 32. Gate openings 36 and dielectric openings 26 are created respectively in gate portions 32 and dielectric layer 22 according to a charged-particle tracking procedure of the type described in U.S. Pat. No. 5,559,389 or 5,564,959. The contents of these two patents are incorporated by reference herein. Electron-emissive elements 24 are created as cones by depositing electrically conductive material through gate openings 36 and into dielectric openings 26 according to a deposition technique of the type described in either of these patents.

Figure 6A:
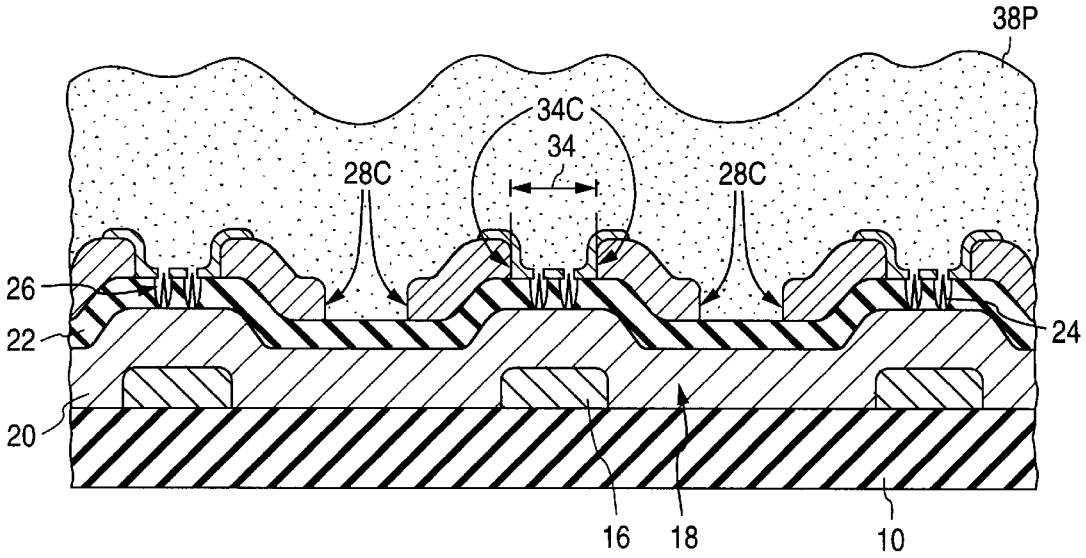
FIGS. 6*a*–6*d* are cross-sectional side views representing steps that employ the invention's teachings in manufacturing the base focusing structure of the electron-emitting device in FIGS. 3–5.
Figure 6B:
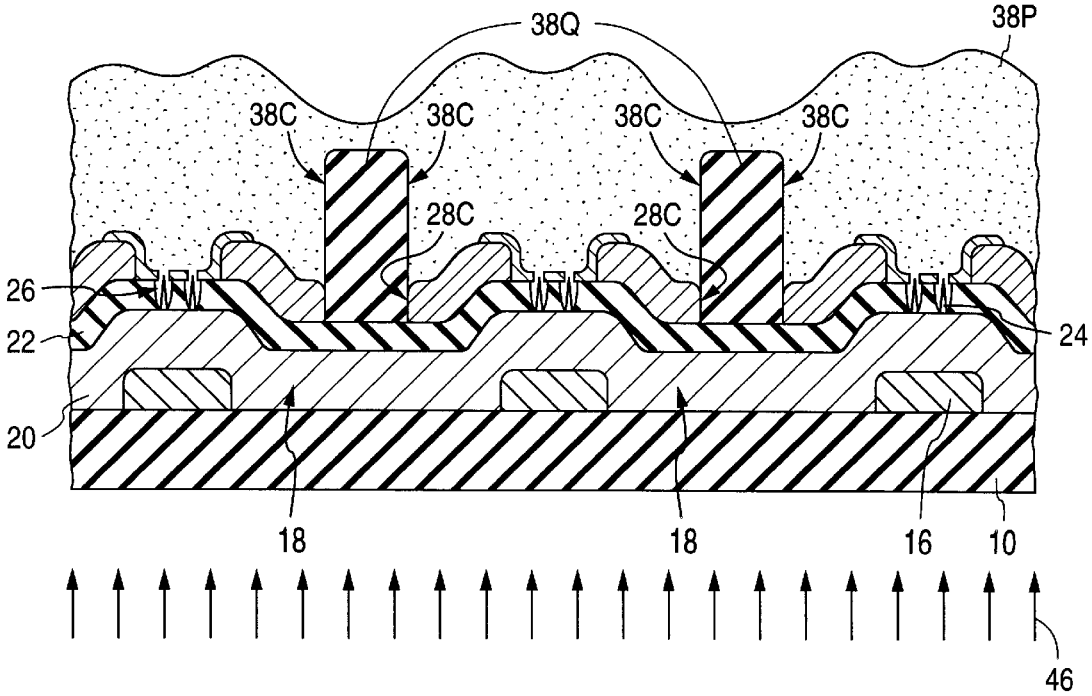
Figure 6C:
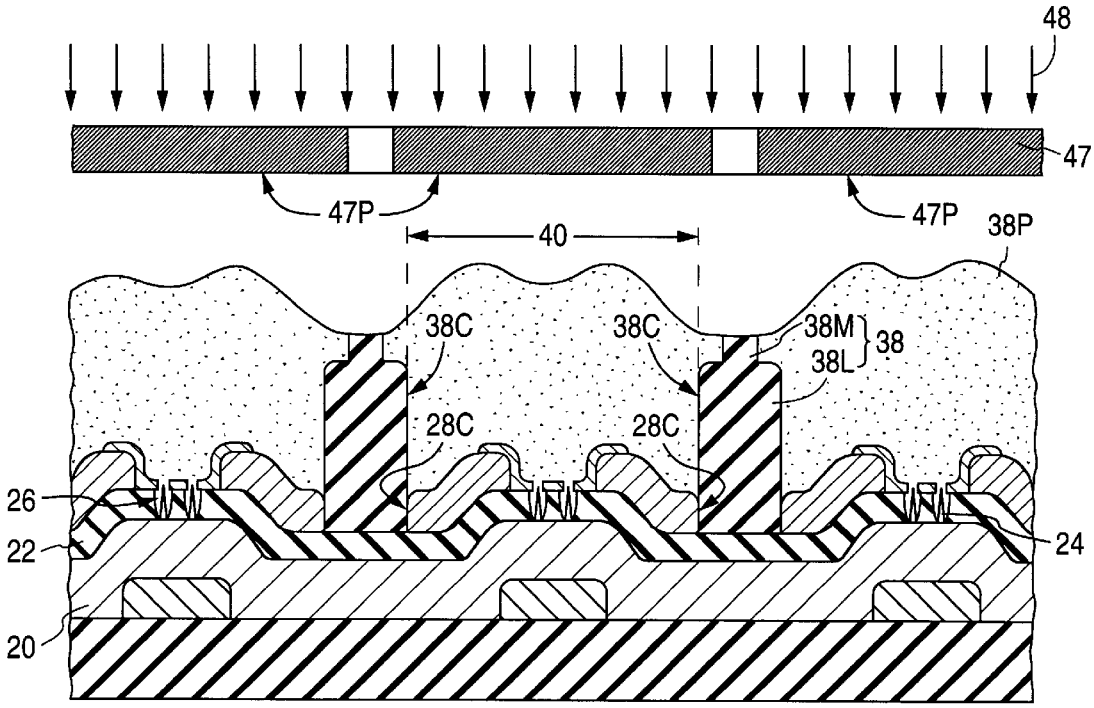

Base focusing structure 38 is now formed as illustrated in FIGS. 6*a*–6*d*. A primary blanket layer 38P of negative-tone electrically insulating actinic material is provided on top of the structure. The electron-emitting structure is subjected to backside actinic radiation 46 that impinges on the lower surface of baseplate 10 as shown in FIG. 6*b*.

Baseplate 10 and dielectric layer 22 largely transmit backside radiation 46 while resistive layer 20 directly transmits a substantial percentage of radiation 46, typically in the vicinity of 40–80%. Electrodes 12 and 28 are largely non-transmissive of radiation 46. Hence, the portion 38Q of primary actinic layer 38P not shadowed by electrodes 12 and 28 is exposed to radiation 46 and changes chemical structure. In so doing, radiation 46 passes through emitter openings 18. Sections of primary layer 38P vertically aligned with lateral control-electrode edges 28C are thereby exposed to radiation 46 to define column-direction lateral edges 38C of base focusing structure 38.

The partially finished structure is now subjected through a photomask 47 to frontside actinic radiation 48 that impinges on top of the structure. See FIG. 6*c*. Photomask 47 has radiation-blocking areas 47B at regions above focus openings 40. Each of blocking areas 47B corresponds to the region indicated by horizontal arrow 44 and vertical arrow 40 in FIG. 3 or 4. Material of primary layer 38P not shadowed by blocking areas 47B is exposed to frontside radiation 48 and changes chemical structure.

The order in which the backside and frontside exposures are performed is generally immaterial. When the actinic material is photo-polymerizable polyimide, such as Olin OCG7020 polyimide, the actinic radiation during both exposures is typically UV light that causes the exposed polyimide to polymerize.

Figure 6D:
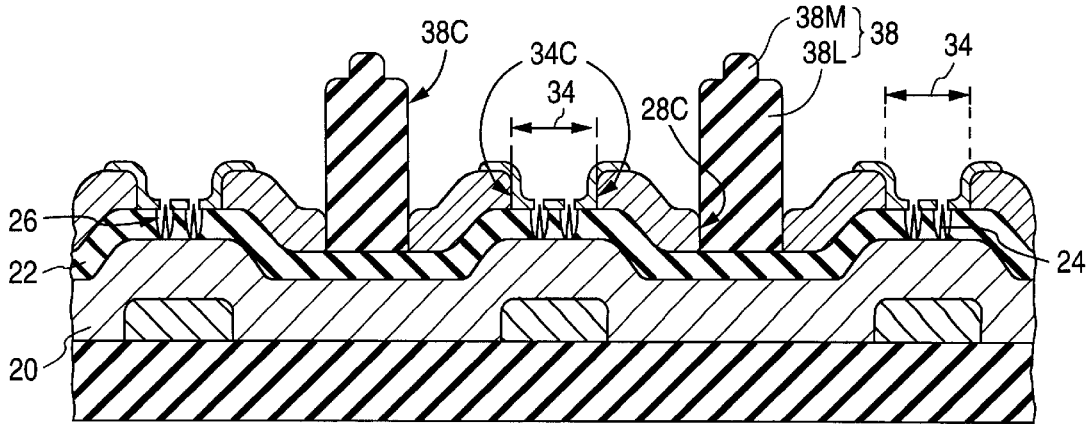

A development operation is performed to remove the unexposed portions of primary layer 38P, thereby producing base focusing structure 38 as shown in FIG. 6*d*. Due to the presence of baseplate 10, backside radiation 46 normally did not fully penetrate primary layer 38P at the backside exposed areas. Since further base focusing portions 38L were only exposed to backside radiation 46, focusing portions 38L are normally shorter than main focusing portion 38M.

Focus coating 39 is formed over base focusing structure 38 by performing a suitable angled evaporation of the focus-coating material. Further information on the angled evaporation is given below. This completes the formation of focusing system 37, thereby yielding the field emitter of FIGS. 3–5.

In subsequent operations, the field emitter is sealed to the light-emitting device through an outer wall. The sealing operation typically entails mounting the outer wall and the spacer walls on the light-emitting device. This composite assembly is then brought into contact with the field emitter and hermetically sealed in such a manner that the internal display pressure is typically $10^{-7}$–$10^{-6}$ torr. The spacer walls contact focusing system 37 along part or all of areas 42 in FIG. 5.

The field emitter of FIGS. 3–5 typically has further lateral dimensions of the magnitude disclosed in, and is fabricated according to the further process information presented in, Spindt et al, co-filed U.S. patent application Ser. No. 08/866,150, the contents of which are incorporated by reference herein. The focus control potential is typically supplied to focus coating 39 by a mechanism of the type described in Barton et al, U.S. patent application Ser. No. 08/866,151, cited above.

Figure 7:
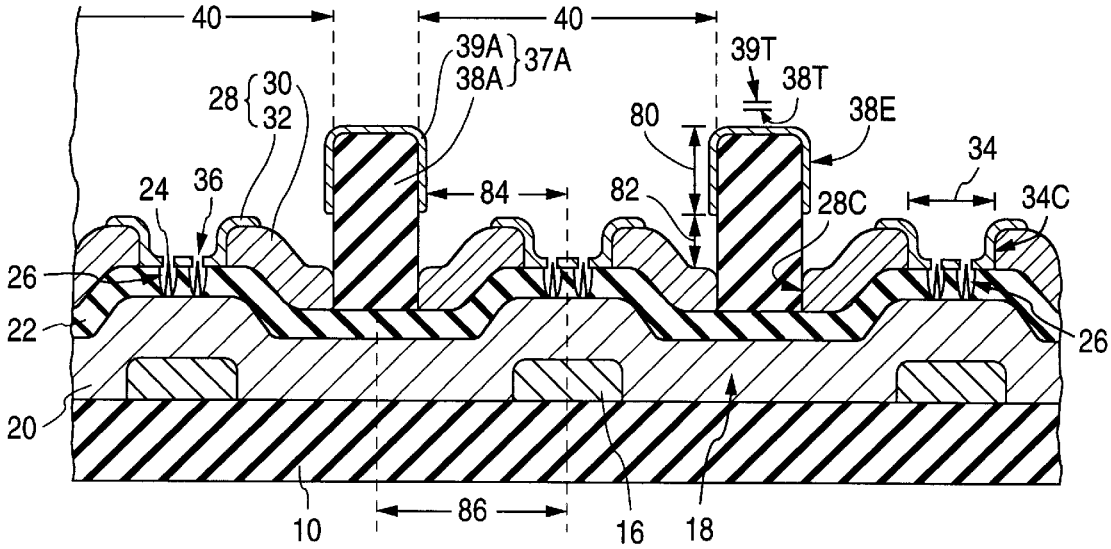
FIG. 7 is a cross-sectional side view of a portion of another electron-emitting device having a focusing system configured according to the invention.

FIG. 7 illustrates a side cross section of part of a matrix-addressed gated field emitter that contains a focusing system 37A similar to focusing system 37. The field emitter of FIG. 7 is otherwise largely the same, and is fabricated in largely the same way, as the field emitter of FIGS. 3–5.

Focusing system 37A in FIG. 7 is created by processing negative-tone primary actinic layer 38P in an alternative way that involves first exposing primary layer 38P to frontside actinic radiation 48 through a photomask having radiation-blocking stripes that extend in the row direction fully across the display's intended active area. Frontside radiation 48 fully penetrates layer 38P at the exposed areas, causing the so-exposed actinic material below the row-direction radiation-blocking stripes to change chemical structure.

The exposure with backside radiation 46 is now performed so that radiation 46 partially penetrates primary layer 38P at the exposed areas. The only unexposed primary actinic material subjected to radiation 46 (and thus not shadowed by electrodes 12 and 28) consists of the rectangular column-direction primary actinic strips situated between the intended locations for focus openings 40 in each focus opening row. Consequently, the exposed material of primary layer 38P has column-direction edges 38E vertically aligned to portions of control-electrode column-direction edges 28C generally at the locations for column-direction focus edges 38C in FIGS. 3 and 4.

Primary layer 38P is now developed to remove the unexposed actinic material. The exposed remainder of layer 38P forms an electrically non-conductive base focusing structure 38A having focus openings 40. Because backside radiation 46 only partially penetrated primary layer 38P at the backside-exposed areas, the height of the full widths of the column-direction rectangular focusing strips between focus openings 40 is both largely uniform and less than the height of the remainder of base focusing structure 38A. Except for this and the fact that focus openings 40 here are, in plan view, more rectangular than openings 40 in FIG. 4, the shape of base structure 38A is generally the same as that shown for base structure 38 in FIGS. 3 and 4.

As with the backside exposure in the process of FIGS. 6*a*–6*d*, the backside exposure in this alternative process can be performed under such conditions that backside radiation 46 fully penetrates primary actinic layer 38P at the exposed areas. The height differential between (a) the column-direction rectangular focusing strips situated between focus openings 40 in each focus opening row and (b) the remainder of base focusing structure 38A is then reduced or eliminated.

Base focusing structure 38A is provided with an electrically non-insulating focus coating 39A analogous to focus coating 39 to form focusing system 37A. Focus coating 39A typically consists of electrical conductive material evaporatively deposited in the manner employed for creating focus coating 39. The resultant field emitter appears generally as shown in FIG. 7. Items 38T and 39T respectively indicate the top surfaces of the taller material of base focusing structure 38A and focus coating 39A elsewhere in the device.

Focusing system 37 or 37A forms an electron focusing lens whose characteristics are largely defined by the lens dimensions. A basic understanding of how the lens dimensions affect the electron focusing is facilitated with reference to the field emitter of FIG. 7 in which the top surface of focus coating 39A is relatively flat. Items 80, 82, and 84 in FIG. 7 indicate the pertinent lens dimensions. The electron lens in the field emitter of FIGS. 3–5 operates in a similar manner to that of FIG. 7.

Before examining the electron focusing optics, it is helpful to further examine the configuration of base focusing structure 38A. In the active region, base structure 38A consists of multiple row-direction strips that intersect multiple column-direction strips to define focus openings 40. Item 96C in FIG. 7 indicates one of the column-direction strips. Each focus opening 40 is formed by the enclosed space where a pair of opposing row-direction focus sidewalls of two consecutive row-direction strips respectively meet a pair of opposing column-direction focus sidewalls 98C of two consecutive column-direction strips 96C.

With the foregoing in mind, the time of flight within the electron lens is basically the time during which emitted electrons are strongly under the influence of the lens. In FIG. 7, the time of flight for the lens formed with focusing system 37A is the distance 80 that focus coating 39A extends vertically along column-direction sidewalls 98C.

The determinant for the entry point of an electron into the lens is the vertical distance 82 from the top of column electrodes 28 to the bottom of focus coating 39A along column-direction sidewalls 98C of base focusing structure 38A in focus openings 40. Although the variation in height of the upper surface of column electrodes 28 is a large fraction of entry-point distance 82 at the illustration scale employed in FIG. 7, the actual height variation in the upper surface of electrodes 28 is a small fraction of entry-point distance 82 and can be largely ignored insofar as the entry-point determinant is concerned. In general, flat-panel display performance improves as entry-point distance 82 is reduced. Accordingly, distance 82 is typically made as small as can be tolerated without running a substantial risk of short circuiting focus coating 39A to electrodes 28.

A third determinant of the electron focusing lens is the lateral half width across which the lens locally influences electrons passing through each focus opening 40. In the field emitter of FIG. 7, the lateral half width for each focus opening 40 is the row-direction distance 84 from focus coating 39A in that focus opening 40 to the row-direction center of column electrode 28 in that opening 40. Lateral half width 84 should be a large fraction of the row-direction distance 86 from the row-direction center of the column-direction strip 96C of base focusing structure 38A along each focus opening 40 to the row-direction center of column electrode 28 in that opening 40. Lens aberration that can lead to undesirable electron trajectories is reduced when lateral half width 84 is a large fraction of row-direction distance 86.

Figure 8:
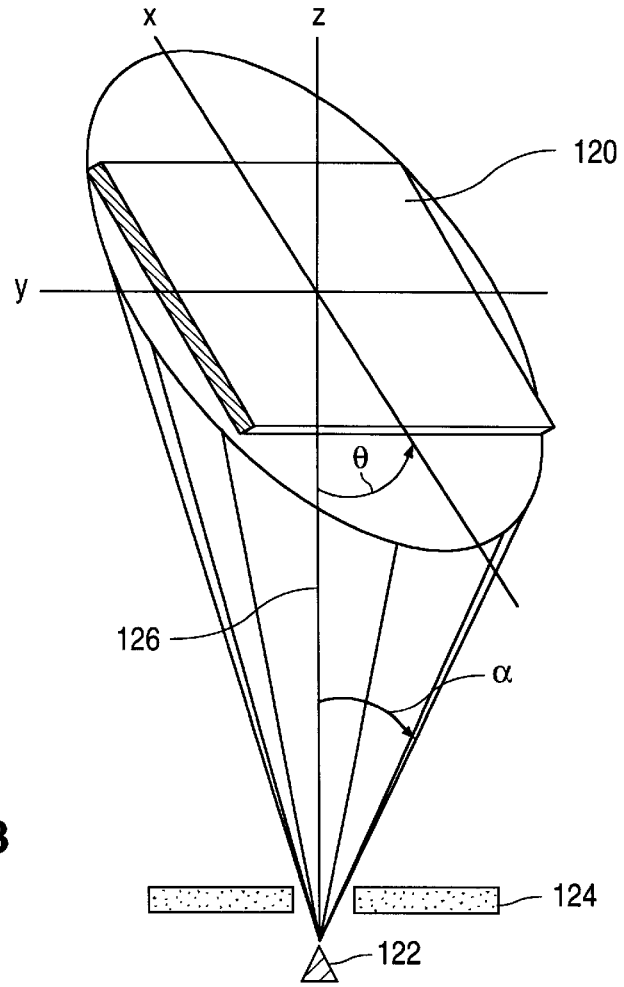
FIG. 8 is a schematic view of an angled deposition system suitable for use in the invention.

A vacuum metallization system suitable for performing an angled metal evaporation to create focus coating 39 or 39A is shown in FIG. 8. Item 120 in FIG. 8 represents the partially finished field emitter. Field emitter 120 is situated along the xy plane of an xyz coordinate system. The approximate center of the upper surface of field emitter 120 is at the center of the xyz coordinate system.

The focus coating metal is provided from an evaporative metal source 122 located a relatively long (lateral) distance from field emitter 120. Metal source 122 is here treated as approximating a point source located in the xz plane. Atoms of the focus coating metal evaporate from source 122 and pass through an aperture in an aperture plate 124. The principal axis 126 of the evaporated metal atoms lies in the xz plane and thus is perpendicular to the y axis.

The aperture in plate 124 limits the distribution of the evaporated metal atoms largely to a solid cone of half angle $\alpha$ relative to principal deposition axis 126. The value of half angle $\alpha$ is chosen so as to be consistent with depositing the focus coating metal across the entire upper surface of base focusing structure 38A subject to any variations in the height of the upper surface of base structure 38A. Angle $\alpha$ is usually in the range of 1–5°. For a deposition area of lateral dimensions 340 mm by 320 mm with a height variation of 10 $\mu$m, $\alpha$ is typically 3°.

Incidence angle $\theta$ is the angle between the x axis (of field emitter 120) and principal deposition axis 126. The value of incidence angle $\theta$ depends on various factors including the depth of focus openings 40 (i.e., the height of column-direction strips 96C between openings 40), the nominal depth to which the focus coating metal enters openings 40, the minimum and maximum depths to which the focus coating metal can enter openings 40 with acceptable display performance, the dimension of openings 40 in the row direction, possibly the dimension of openings 40 in the column direction, and the nominal thickness of focus coating 39 or 39A. Incidence angle $\theta$ is usually in the range of 5–25°. For the field emitter of FIG. 7 at a typical value of 80–90 $\mu$m for the row-direction dimension of focus openings 40, and for a maximum metallization depth of approximately 25 $\mu$m into focus openings 40 at a focus coating thickness of 50 $\mu$m, $\theta$ is typically 15°.

The angled evaporative focus metal deposition with the system of FIG. 8 is conducted in such a manner that focus coating 39A is formed on substantially the entire top surface of base focusing structure 38A but only partway into each focus opening 40. No part of the focus coating metal should accumulate deep enough along any sidewall of any focus opening 40 so as to electrically short coating 39A to any column electrode 28.

Subject to the preceding requirements, the angled deposition of focus coating 39A can be performed in various ways with system 122/124 of FIG. 8. For example, if focus openings 40 are approximately square or circular as viewed perpendicularly to baseplate 10, the angled deposition can be performed as system 122/124 is rotated around the field emitter, or vice versa. The value of incidence angle θ is chosen so as to avoid having any of the focus coating metal reach the bottom of any of openings 40. The rate at which system 122/124 rotates relative to the field emitter can be constant or variable.

Focus openings 40 are often of significantly greater dimension in one major lateral direction than in the transverse lateral direction. If the angled deposition is done according to the rotational technique at a constant θ value, the consequence of openings 40 being of significantly greater lateral dimension in one lateral direction than in the transverse lateral direction is that the focus coating metal accumulates to significantly unequal depths in openings 40. In some situations, this unequal accumulation can lead to a significant risk of short circuiting focus coating 39 or 39A to control electrodes 28.

For example, focus openings 40 are typically 80–90 μm in the column direction and 120–140 μm in the row direction. Column direction sidewalls 98C of openings 40 are thus significantly longer than the row direction sidewalls of openings 40. Assuming that incidence angle θ is held constant, performing the angle deposition of coating 39A while the field emitter is being rotated relative to deposition system 122/124 results in the focus coating metal accumulating deeper into openings 40 along the row-direction sidewalls than column-direction sidewalls 98C.

As mentioned above, the value of entry-point distance 82 in FIG. 7 needs to be small (compared to the sum of distances 80 and 82) to achieve good electron focusing. A small value of entry-point distance 82 corresponds to focus coating 39A extending deep into focus openings 40 along column-direction sidewalls 98C. If the angled focus metal deposition is done according to the rotational technique at a constant θ value, attempting to make entry-point distance 82 small can lead to short circuiting between column electrodes 28 and focus coating 39A along the row-direction sidewalls because accumulation of the focus coating metal into openings 40 is deeper along the row-direction sidewalls than along column-direction sidewalls 98C.

Another way of performing the angled evaporative deposition is to deposit the focus coating metal from two static positions on opposite sides of the field emitter. By appropriately choosing the locations for these two static positions, the possibility of short circuiting focus coating 39 or 39A to control electrodes 28 due to focus openings 40 being of significantly greater dimension in one major lateral direction than in the transverse lateral direction is substantially avoided. In general, the opposite-position technique entails arranging the evaporative deposition system so that, in each of the positions, the principal deposition axis is roughly perpendicular to the lateral direction in which focus openings 40 are of maximum dimension. For the typical case in which openings 40 are of greater dimension in the column direction than in the row direction, the principal deposition axis for each of the opposite positions is roughly perpendicular to the column direction.

Some azimuthal (yaw) variation—i.e., angular variation about the vertical—in the angle between each principal deposition axis and the lateral direction of maximum focus opening dimension is tolerable and, in some cases desirable. For example, when the row-direction strips of base focusing structure 38A are taller than column-direction strips 96C, the amounts of focus coating metal that accumulate on the row sidewall portions of base structure 38A extending from the tops of the row direction strips down to the tops of column-direction strips 96C are comparatively small if the principal deposition axes are exactly perpendicular to the column direction.

This problem is addressed by arranging for each principal deposition axis to extend perpendicular to a lateral direction that differs by an azimuthal angle of 5–25°, typically 10°, from the lateral direction in which focus openings 40 are of maximum dimension. The two deposition positions remain opposite each other so that their principal deposition axes differ azimuthally (i.e., as viewed vertically) by approximately 180°.

By depositing focus coating 39A in this slightly off-perpendicular manner, the focus coating metal accumulates adequately on one of each opposing pair of the above-mentioned sidewall portions of base focusing structure 38A during the deposition from one of the positions and adequately on the other of that pair of sidewall portions during the deposition from the other position. The net result is that coating 39A is continuous along the top of base structure 38A including the row sidewall portions extending from the tops of the row-direction strips down to the tops of column-direction strips 96C. The value of the azimuthal angle and the depth to which coating 39A extends into focus openings 40 along column-direction sidewalls 98C can readily be chosen to avoid having coating 39A extend down any row-direction sidewall in any opening 40 to contact a column electrode 28.

The opposite-position angled deposition can be performed in a serial manner with a single angled deposition source. That is, the focus coating material can be deposited from one of the positions after which the deposition source is adjusted to the other position, and more of the focus coating material is deposited from the second position. Alternatively, the opposite-position angled deposition can be done with two deposition sources, typically simultaneously, with each of the sources at a different one of the two positions.

Figure 9:
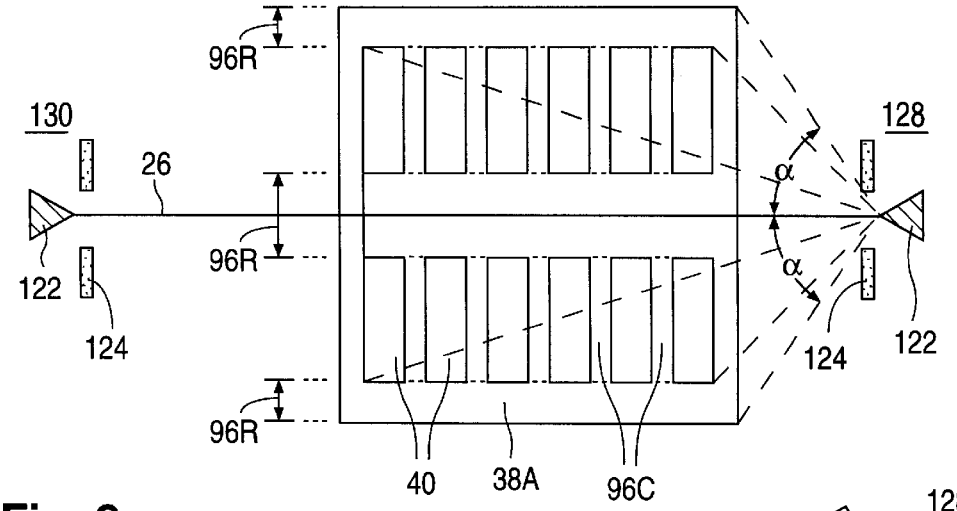
FIG. 9 is a simplified plan view of the active area of the electron-emitting device of FIG. 7 during angled deposition of the focus coating according to the invention.

FIG. 9 illustrates how the present opposite-position deposition technique is applied to the field emitter of FIG. 7 to form focus coating 39A. Two focus opening rows and six focus opening columns are shown in FIG. 9. Items 96R in FIG. 9 indicate three of the row-direction strips of base focusing structure 38A. Items 128 and 130 represent the opposite positions from which deposition system 122/124 is employed to perform the angled focus metal deposition. Positions 128 and 130 are located laterally outside the active region containing electron-emissive elements 24 and focus openings 40. Position 128 is situated to the right of the active region. Position 130 is situated the left of the active region.

Position 128 is so located that principal deposition axis 126 for deposition system 122/124 is roughly perpendicular to the column direction subject to the azimuthal variation described above. Likewise, position 130 is so located that principal deposition axis 126 for system 122/124 is roughly perpendicular to the column direction. Inasmuch as focus control is more critical in the row direction than in the column direction, principal deposition axes 126 for positions 128 and 130 extend roughly perpendicular to the lateral direction that is perpendicular to the lateral direction of most critical focus control. Deposition axes 126 also lie in approximately the same vertical plane.

Figure 10A:
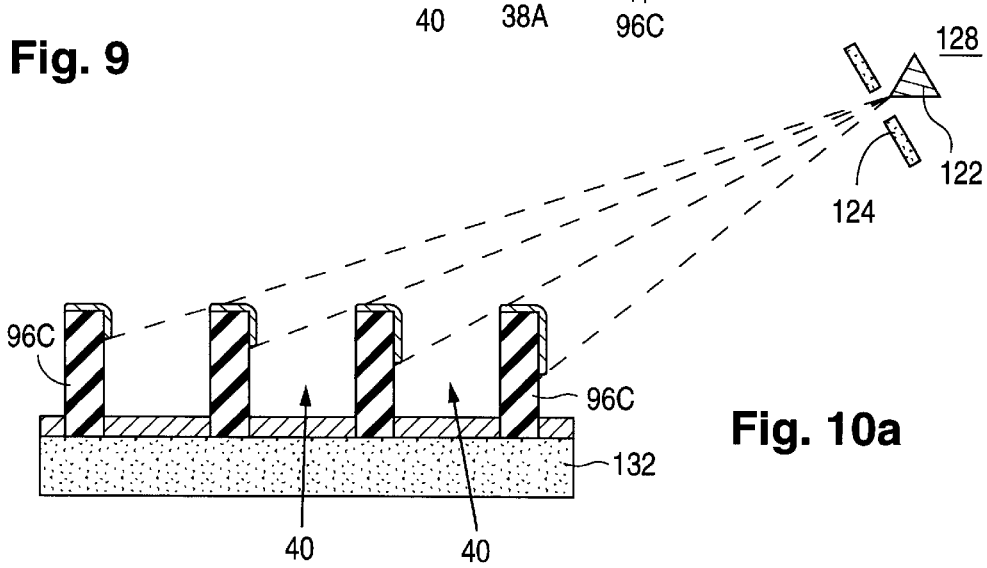
FIGS. 10*a* and 10*b* are simplified cross-sectional side views representing steps that employ the invention's teachings in depositing the focus coating of the electron-emitting device in FIGS. 7 and 9.
Figure 10B:
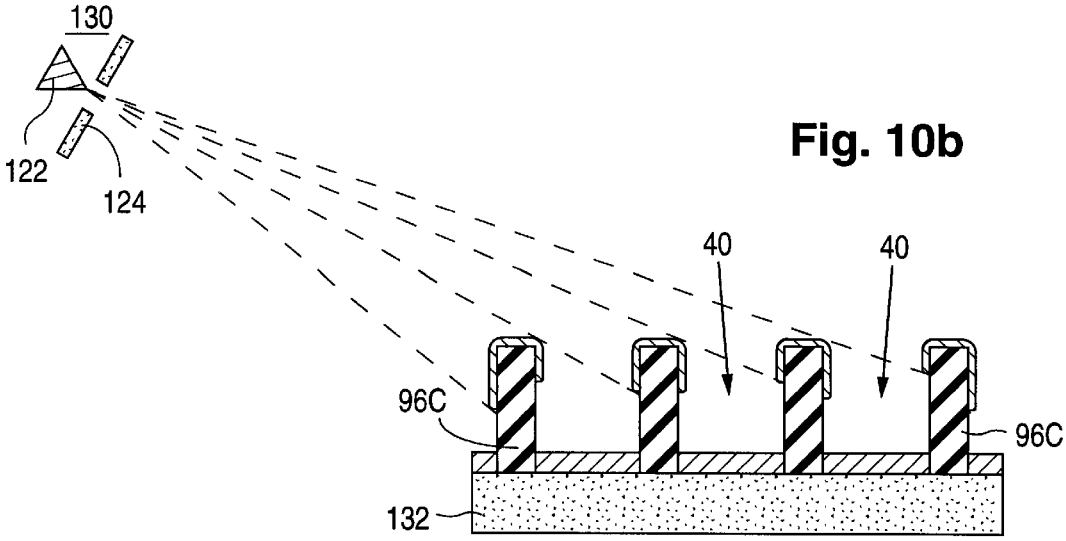

FIGS. 10*a* and 10*b* depict how the opposite-position deposition with system 122/124 is performed on the field emitter of FIG. 7. Item 132 in FIGS. 10*a* and 10*b* generally represents the structure (including electron-emissive elements 24 and row electrodes 12) below control electrodes 28 and base focusing structure 38A. In FIG. 10*a*, the angled deposition is initiated from position 128. Atoms of the focus coating metal evaporatively accumulate on top of base focusing structure 38A and partway into focus openings 40 along left-hand sidewalls 98C.

The field emitter and deposition system 122/124 are rotated through an azimuthal angle of 180° relative to each other to place system 122/124 at position 130. This can entail moving the field emitter, moving system 122/124, or moving both the field emitter and system 122/124.

From position 130, atoms of the focus coating metal evaporatively accumulate over the top of base focusing structure 38A and partway into focus openings 40 along right-hand sidewalls 98C. The result is that focus coating 39A penetrates only partway into each focus opening 40.

The amount that focus coating 39A penetrates into each focus opening 40 along left-hand sidewall 98C relative to right-hand sidewall 98C varies somewhat from opening 40 to opening 40. With suitable choices for the deposition parameters, this variation is normally sufficiently small that few electrons are underfocused or overfocused and reach unintended light-emissive elements in the light-emitting device situated opposite the field emitter in the final FED.

Instead of being static, deposition positions 128 and 130 can be translated laterally in a largely fixed lateral direction during the deposition from each of positions 128 and 130. The translation is typically performed in the column direction. For example, position 128 can be moved from a location near the bottom row of focus openings 40 to a location near the top row of openings 40 (or vice versa). The same applies to position 130.

With cone half angle $\alpha$ suitably restricted, moving positions 128 and 130 in the column direction enables the thickness of focus coating 39A to be made quite uniform across the top of base focusing structure 38A. The depths to which coating 39A extends into focus openings 40 along column-direction sidewalls 98C can likewise be made quite uniform from one opening 40 to another opening 40 in each column of openings 40. In addition, translating positions 128 and 130 in the column direction permits positions 128 and 130 to be brought closer to the field emitter. Coating 39A can thus be deposited on a field emitter of large area without placing the deposition positions far from the field emitter so as to necessitate a very large deposition chamber.

During the opposite-position angled deposition, a shadow mask (not shown) is typically employed at the periphery of focus coating 38A to prevent the focus coating metal from accumulating on the exposed ends of electrodes 28 and 12 to short them together. Alternatively, any of the focus coating metal that accumulates on the exposed ends of electrodes 28 and 12 can be removed according to a suitable masked etch procedure depending on the materials that form electrodes 28 and 12, on one hand, and the focus coating metal, on the other hand.

Figure 11:
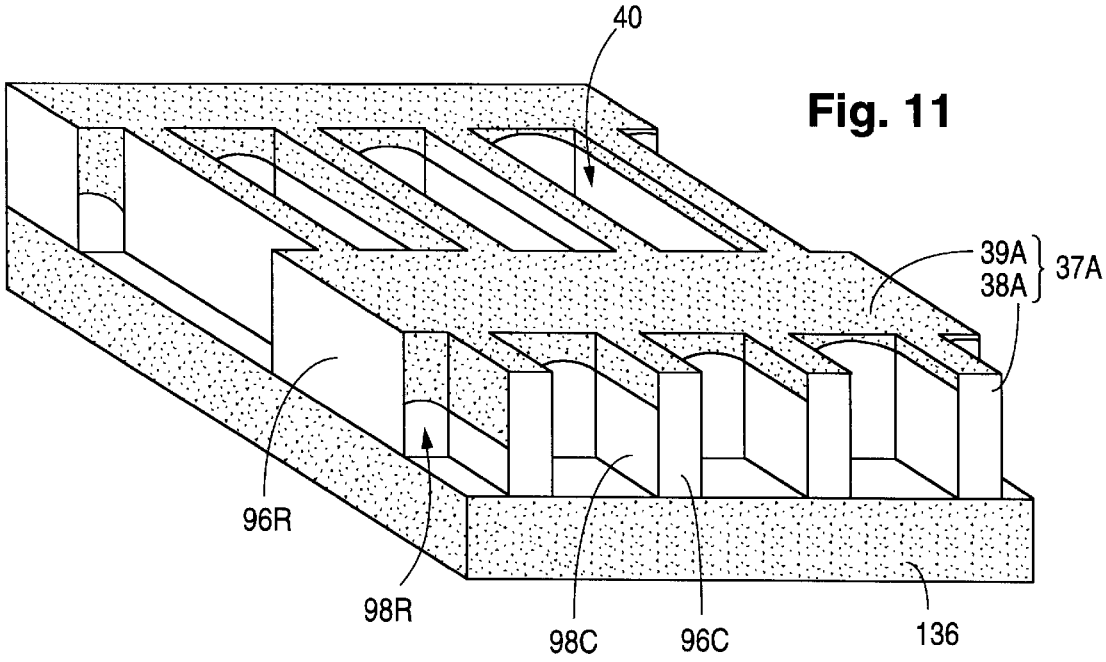
FIG. 11 is a simplified perspective view of how the electron-emitting device of FIGS. 7 and 9 appears when the focus coating is formed over the base focusing structure according to the invention.

A perspective view of part of focusing system 37A of the field emitter of FIGS. 7 and 9, as processed according to the steps generally shown in FIGS. 10*a* and 10*b*, is presented in FIG. 11. Item 136 in FIG. 11 indicates the structure below focusing system 37A. Items 98R are the row-direction sidewalls of row-direction strips 96R within focus openings 40. FIG. 11 show how focus coating 39A extends no deeper into each focus opening 40 along row-direction sidewalls 98R of that opening 40 than column-direction sidewalls 98C of that opening 40.

Figure 12:
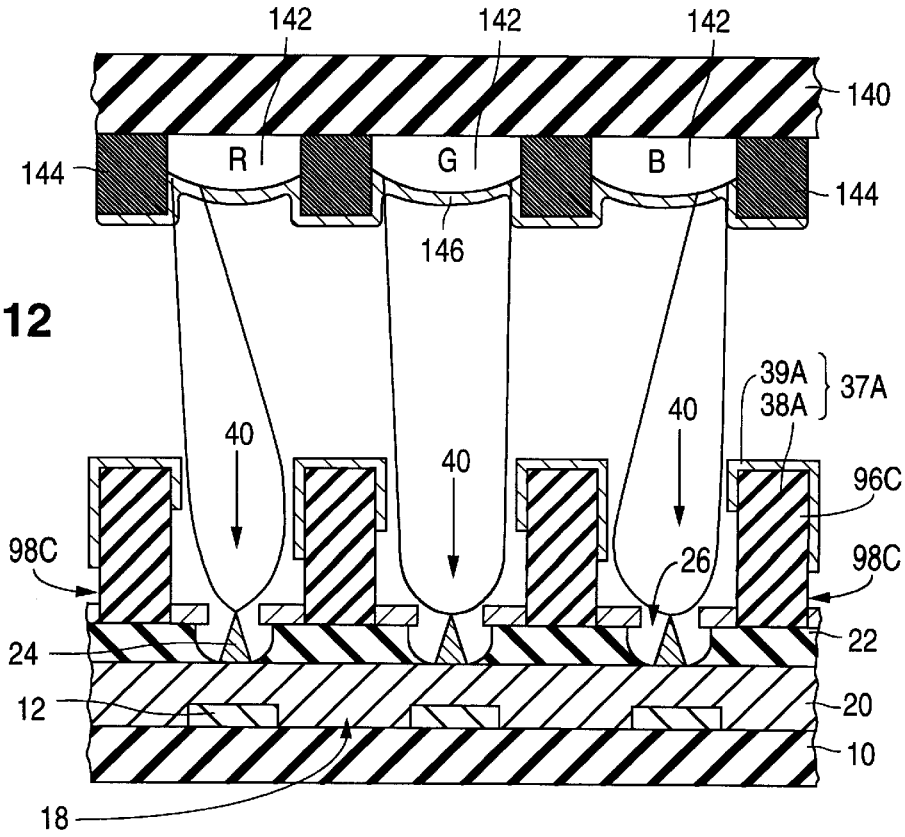
FIG. 12 is a cross-sectional schematic side view of how focus control occurs in the electron-emitting device of FIGS. 7, 9, and 11.

FIG. 12 illustrates part of the active region of an FED containing the field emitter of FIGS. 7, 9 and 11. For simplicity, each of the sets of electron-emissive elements 24 that emit electrons passing through each focus opening 40 is represented by one element 24 in FIG. 12. A light-emitting device is situated across from the field emitter in FIG. 12. The light-emitting device contains a flat transparent faceplate 140 typically consisting of glass. Laterally separated phosphor light-emissive elements 142 are situated over the interior surface of faceplate 140 in a pattern corresponding to the pattern of the sets of electron-emissive elements 24 in the field emitter. A black matrix 144 laterally surrounds light-emissive elements 142. A thin light-reflective anode layer 146 lies on light-emissive elements 24 and black matrix 144.

The extremes of focus control are illustrated in FIG. 12. Focus coating 39A goes deeper into left-hand focus opening 40 along its left-hand sidewall 98C than along its right-hand sidewall 98C. The reverse occurs in right-hand focus opening 40. Focus coating 39A extends approximately equidistant into central focus opening 40 along its column-direction sidewalls 98C. The portions of coating 39A in central opening 40 cause the electrons passing through central opening 40 to strike opposite (i.e., intended) light-emissive element 146 in a roughly symmetric manner on the average. While the striking pattern is skewed to the left or right in the case of left-hand or right-hand opening 40, the portions of focus coating 39A along that opening 40 still control the electron trajectories so that substantially all of the emitted electron strike opposite light-emissive element 146.

A flat-panel CRT display containing an electron-emitting device manufactured according to the invention operates in the following way. The anode in the light-emitting device is maintained at high positive potential relative to control electrodes 28 and emitter electrodes 12. When a suitable potential is applied between (a) a selected one of control electrodes 28 and (b) a selected one of emitter electrodes 12, the so-selected gate portion 32 extracts electrons from the selected set of electron-emissive elements 24 and controls the magnitude of the resulting electron current. Desired levels of electron emission typically occur when the applied gate-to-cathode parallel-plate electric field reaches 20 volts/$\mu$m or less at a current density of 0.1 mA/cm$^2$ as measured at the light-emissive elements when they are high-voltage phosphors. The extracted electrons pass through the anode layer and selectively strike the phosphor elements, causing them to emit light visible on the exterior surface of the light-emitting device.

Directional terms such as "top", "bottom", "upper", and "lower" have been employed in describing the present invention to establish a frame of reference by which the reader can more easily understand how the various parts of the invention fit together. In actual practice, the components of the present electron-emitting device may be situated at orientations different from that implied by the directional items used here. The same applies to the way in which the fabrication steps are performed in the invention. Inasmuch as directional items are used for convenience to facilitate the description, the invention encompasses implementations in which the orientations differ from those strictly covered by the directional terms employed here.

While the invention has been described with reference to particular embodiments, this description is solely for the purpose of illustration and is not to be construed as limiting the scope of the invention claimed below. For instance, deposition system 122/124 can be rotated around the field emitter (or vice versa) during the deposition of focus coating 39A as incidence angle θ is appropriately adjusted to enable coating 39A to extend partway down column-direction sidewalls 98C but not fully down the row-direction sidewalls of base focusing structure 38A. Incidence angle θ is reduced in value as system 122/124 rotates relative to the field emitter from a position in which principal deposition axis 126 is perpendicular to the column direction to a position in which axis 126 is parallel to the column direction, and vice versa.

Focus openings 40 can have non-rectangular shapes. The techniques used to deposit coating 39A can be applied to focus coating 39. Deposition techniques other than evaporation can be employed to form coating 39 or 39A.

Each of the sets of electron-emissive elements 24 can consist of only one element 24 rather than multiple elements 24. Multiple electron-emissive elements can be situated in one opening through dielectric layer 22. Electron-emissive elements 24 can have shapes other than cones. One example is filaments, while another is randomly shaped particles such as diamond grit.

The principles of the invention can be applied to other types of matrix-addressed flat-panel displays. Candidate flat-panel displays for this purpose include matrix-addressed plasma displays and active-matrix liquid-crystal displays. Various modifications and applications may thus be made by those skilled in the art without departing from the true scope and spirit of the invention as defined in the appended claims.

We claim:

1. A system for focusing electrons emitted by an electron-emissive element (a) situated in a dielectric opening in a dielectric layer and (b) exposed through a control opening in an overlying control electrode, the system comprising:

a base focusing structure overlying the dielectric layer and penetrated by a focus opening that overlies the electron-emissive element, the base focusing structure having a pair of opposing first sidewalls and a pair of opposing second sidewalls that respectively meet the first sidewalls to define the focus opening; and a focus coating overlying the base focusing structure within the focus opening so as to extend partway down into the focus opening.

2. A system as in claim 1 wherein the focus coating is spaced apart from the control electrode.

3. A system as in claim 1 wherein the focus coating extends at least 50% deep into the focus opening along both the first and second sidewalls.

4. A system as in claim 1 wherein the focus coating is of lower resistivity than the base focusing structure.

5. A system as in claim 4 wherein the base focusing structure comprises electrically non-conductive material, and the focus coating comprises electrically non-insulating material.

6. A system as in claim 5 wherein the non-insulating material of the focus coating consists primarily of at least one of aluminum, chromium, nickel, silver, and gold.

7. A system as in claim 1 wherein the focus coating averagely extends deeper into the focus opening along the first sidewalls than along the second sidewalls.

8. A system as in claim 7 wherein:

the first sidewalls extend generally in a first lateral direction;

the second sidewalls extend generally in a second lateral direction different from the first direction; and focus control of electrons emitted by the electron-emissive element is more critical in the second direction than in the first direction.

9. A system as in claim 8 wherein the focus opening is of greater dimension in the first direction than in the second direction.

10. A system as in claim 9 wherein the second sidewalls are taller than the first sidewalls.

11. A system as in claim 1 wherein the system is also operable for focusing electrons emitted by at least one additional electron-emissive element, each additional electron-emissive element (a) situated in an additional dielectric opening in the dielectric layer and (b) exposed through an additional control opening in the control electrode, the focus opening overlying each additional electron-emissive element.

12. A system as in claim 11 wherein the control electrode comprises a main control portion and a thinner gate portion which contacts the main portion and spans a main opening through the main portion, each control opening extending through the gate portion at a location generally laterally bounded by the main opening.

13. A system as in claim 12 wherein the focus opening laterally surrounds the main opening as viewed generally perpendicular to the dielectric layer.

14. A device comprising:

electron-emitting means comprising a multiplicity of laterally separated sets of electron-emissive elements;

a dielectric layer having dielectric openings in which the electron-emissive elements are situated;

a plurality of control electrodes overlying the dielectric layer and having control openings through which the electron-emissive elements are exposed; and a focusing system for focusing electrons emitted by the electron-emissive elements, the focusing system comprising (a) a base focusing structure overlying the dielectric layer and penetrated by a like multiplicity of focus openings, each of which overlies a different corresponding one of the sets of electron-emissive elements, the base focusing structure comprising plural laterally separated first strips extending generally in a first lateral direction and plural laterally separated second strips extending in a second lateral direction different from the first direction, each consecutive pair of the first strips intersecting each consecutive pair of the second strips to largely define a different one of the focus openings, and (b) a focus coating overlying the base focusing structure within the focus openings so as to extend partway down into each focus opening, focus control of electrons emitted by the electron-emissive elements being more critical in the second direction than in the first direction, the focus coating averagely extending deeper into the focus openings along the first strips than along the second strips.

15. A device as in claim 14 wherein the focus coating is spaced apart from the control electrodes and is of lower resistivity than the base focusing structure.

16. A device as in claim 14 wherein the focus coating also overlies the base focusing structure outside the focus openings.

17. A device as in claim 14 wherein the first strips are longer than the second strips, whereby the focus openings are longer in the first direction than in the second direction.

18. A device as in claim 14 wherein the focus coating is maintained approximately at a selected potential.

19. A device as in claim 14 further including anode means situated above, and spaced apart from, the electron-emissive elements for collecting electrons emitted by the electron-emissive elements.

20. A device as in claim 19 wherein the anode means is part of a light-emitting device having a like multiplicity of laterally separated light-emissive elements situated respectively opposite the sets of electron-emissive elements for emitting light upon being struck by electrons emitted from the electron-emissive elements.

21. A system for focusing electrons emitted by an electron-emissive element (a) situated in a dielectric opening in a dielectric layer and (b) exposed through a control opening in an overlying control electrode, the system comprising:

a base focusing structure overlying the dielectric layer and penetrated by a focus opening that overlies the electron-emissive element, the focus opening being of greater dimension in a first lateral direction than in a second lateral direction different from the first direction; and a focus coating overlying the base focusing structure within the focus opening so as to extend partway down into the focus opening.

22. A system as in claim 21 wherein focus control of electrons emitted by the electron-emissive element is more critical in the second direction than in the first direction.

23. A system as in claim 22 wherein the directions are largely perpendicular to each other.

24. A system as in claim 22 wherein the focus coating is spaced apart from the control electrode.

25. A system as in claim 22 wherein the focus coating extends at least 50% deep into the focus opening.

26. A system as in claim 22 wherein the focus coating is of lower resistivity than the base focusing structure.

27. A system as in claim 26 wherein the base focusing structure comprises electrically non-conductive material, and the focus coating comprises electrically non-insulating material.

28. A system as in claim 22 wherein the focus coating extends significantly non-uniformly deep into the focus opening.

29. A system as in claim 22 wherein the base focusing structure has (a) a pair of opposing first sidewalls that extend generally in the first direction and (b) a pair of opposing second sidewalls that extend generally in the second direction and respectively meet the first sidewalls to define the focus opening.

30. A system as in claim 29 wherein the focus coating averagely extends deeper into the focus opening along the first sidewalls than along the second sidewalls.

31. A system as in claim 29 wherein the second sidewalls are of different average height than the first sidewalls.

32. A system as in claim 31 wherein the second sidewalls are taller than the first sidewalls.

33. A system as in claim 21 wherein the system is also operable for focusing electrons emitted by at least one additional electron-emissive element, each additional electron-emissive element (a) situated in an additional dielectric opening in the dielectric layer and (b) exposed through an additional control opening in the control electrode, the focus opening overlying each additional electron-emissive element.

34. A system as in claim 33 wherein the control electrode comprises a main control portion and a thinner gate portion which contacts the main portion and spans a main opening through the main portion, each control opening extending through the gate portion at a location generally laterally bounded by the main opening.

35. A system as in claim 34 wherein the focus opening laterally surrounds the main opening as viewed generally perpendicular to the dielectric layer.

36. A system for focusing electrons emitted by an electron-emissive element (a) situated in a dielectric opening in a dielectric layer and (b) exposed through a control opening in an overlying control electrode, the system comprising:

a base focusing structure overlying the dielectric layer and penetrated by a focus opening that overlies the electron-emissive element; and a focus coating overlying the base focusing structure within the focus opening so as to extend partway down into the focus opening, the focus coating extending significantly non-uniformly deep into the focus opening.

37. A system as in claim 36 wherein the focus coating extends deeper into the focus opening where a lateral tangent to the focus opening extends in a first lateral direction than where a lateral tangent to the focus opening extends in a second lateral direction different from the first direction.

38. A system as in claim 37 wherein the directions are largely perpendicular to each other.

39. A system as in claim 37 wherein the focus opening is of different height where a lateral tangent to the focus opening extends in the first direction than where a lateral tangent to the focus opening extends in the second direction.

40. A system as in claim 39 wherein the focus opening is taller where a lateral tangent to the focus opening extends in the first direction than where a lateral tangent to the focus opening extends in the second direction.

41. A system as in claim 37 wherein focus control of electrons emitted by the electron-emissive element is more critical in the second direction than in the first direction.

42. A system as in claim 37 wherein the focus opening is of greater dimension in the first direction than in the second direction.

43. A system as in claim 37 wherein the focus coating is of lower resistivity than the base focusing structure.

44. A system as in claim 36 wherein the system is also operable for focusing electrons emitted by at least one additional electron-emissive element, each additional electron-emissive element (a) situated in an additional dielectric opening in the dielectric layer and (b) exposed through an additional control opening in the control electrode, the focus opening overlying each additional electron-emissive element.

45. A system as in claim 44 wherein the control electrode comprises a main control portion and a thinner gate portion which contacts the main portion and spans a main opening through the main portion, each control opening extending through the gate portion at a location generally laterally bounded by the main opening.

46. A system as in claim 45 wherein the focus opening laterally surrounds the main opening as viewed generally perpendicular to the dielectric layer.

47. A device comprising:

electron-emitting means comprising a multiplicity of laterally separated sets of electron-emissive elements;

a dielectric layer having dielectric openings in which the electron-emissive elements are situated;

a plurality of control electrodes overlying the dielectric layer and having control openings through which the electron-emissive elements are exposed, the focus openings being of greater respective dimensions in a first lateral direction than in a second lateral direction different from the first direction; and a focusing system for focusing electrons emitted by the electron-emissive elements, the focusing system comprising (a) a base focusing structure overlying the dielectric layer and penetrated by a like multiplicity of focus openings, each of which overlies a different corresponding one of the sets of electron-emissive elements, and (b) a focus coating overlying the base focusing structure within the focus openings so as to extend partway down into each focus opening.

48. A device as in claim 47 wherein focus control of electrons emitted by the electron-emissive elements is more critical in the second direction than in the first direction.

49. A device as in claim 48 wherein the directions are largely perpendicular to each other.

50. A device as in claim 48 wherein the focus coating is of lower resistivity than the base focusing structure.

51. A device as in claim 48 wherein the focus coating also overlies the base focusing structure outside the focus openings.

52. A device as in claim 48 wherein:

the base focusing structure comprises plural laterally separated first strips extending generally in the first direction and plural laterally separated second strips extending generally in the second direction, each consecutive pair of the first strips respectively intersecting each consecutive pair of the second strips to largely define a different one of the focus openings; and the focus coating averagely extends deeper into the focus openings along the first strips than along the second strips.

53. A device as in claim 52 wherein the first strips are longer than the second strips, whereby the focus openings are longer in the first direction than in the second direction.

54. A device as in claim 48 wherein the focus coating is maintained approximately at a selected potential.

55. A device as in claim 48 further including anode means situated above, and spaced apart from, the electron-emissive elements for collecting electrons emitted by the electron-emissive elements.

56. A device as in claim 55 wherein the anode means is part of a light-emitting device having a like multiplicity of laterally separated light-emissive elements situated respectively opposite the sets of electron-emissive elements for emitting light upon being struck by electrons emitted from the electron-emissive elements.

* * * * *